United States Patent [19]

Williams

[11] 4,197,784

[45] Apr. 15, 1980

[54] SEMI-AUTOMATIC REVOLVER

[76] Inventor: Robert W. Williams, 61 East Blvd., Gloversville, N.Y. 12078

[21] Appl. No.: 855,888

[22] Filed: Nov. 30, 1977

[51] Int. Cl.[2] ..... F41D 7/04

[52] U.S. Cl. ..... 89/155; 89/193

[58] Field of Search ..... 42/59; 89/155, 156, 89/191 R, 193

[56] References Cited

U.S. PATENT DOCUMENTS

| | | | |
|---|---|---|---|
| 515,064 | 2/1894 | Unge | 89/155 |
| 1,835,286 | 12/1931 | Dickinson | 89/155 |
| 1,972,763 | 11/1933 | Dutton | 89/155 |
| 2,560,292 | 7/1951 | Kauch | 89/193 |
| 3,045,556 | 7/1962 | Westmoreland | 89/155 |
| 3,051,057 | 8/1962 | Ivy | 89/156 |
| 3,055,270 | 9/1962 | Miller | 42/59 |
| 3,470,788 | 10/1969 | Virtanen | 89/155 |

FOREIGN PATENT DOCUMENTS

| | | | |
|---|---|---|---|
| 14130 | of 1886 | United Kingdom | 89/191 |

*Primary Examiner*—Stephen C. Bentley

*Attorney, Agent, or Firm*—Watts, Hoffmann, Fisher & Heinke Co.

[57] ABSTRACT

A revolver includes a mechanism for automatically cocking the hammer and indexing the cylinder after each shot by utilizing gas pressure generated after cartridge ignition. The barrel includes a gas cylinder open at the rearward end and extending forwardly of the frame. The frame includes a longitudinally extending bore aligned with the gas cylinder. A displaceable member is fitted within the gas cylinder and the frame bore and is biased to a forward position by a biasing member such as a spring. An opening in the barrel provides communication between the bore of the barrel and the gas cylinder so that increased gas pressure caused by cartridge ignition acts on the displaceable member to move it rearwardly. The displaceable member contacts the hammer to urge the hammer to a cocked position and also index the cylinder, thus readying the revolver automatically for the next shot.

13 Claims, 4 Drawing Figures

SEMI-AUTOMATIC REVOLVER

REFERENCE TO RELEVANT PATENTS

U.S. Pat. No. 3,051,057, J. T. Ivy, "Automatic Hammer Cocking and Cylinder Indexing Means for Revolvers."

U.S. Pat. No. 1,835,286, J. M. Dickinson, "Automatic Firearm."

BACKGROUND OF THE INVENTION

1. Field of the Invention

The invention relates to handguns and, more particularly, to a revolver-type handgun in which the hammer is cocked and the cylinder is indexed automatically upon the firing of a cartridge.

2. Description of the Prior Art

Handguns are of two general types, revolvers and semiautomatics. A semi-automatic handgun does not fire repeatedly upon a sustained depression of the trigger, but rather only cocks itself and inserts a new cartridge into the firing chamber automatically upon the firing of a cartridge. Nevertheless, this enables the handgun to be fired quite rapidly, usually as fast as the trigger can be pulled, a decided advantage in many applications.

A revolver-type handgun, on the other hand, posesses many advantages over semi-automatic-type handguns, including strength, simplicity, and safety (in part because the cartridges readily may be examined). One of the chief drawbacks of a revolver is its inability to fire rapidly with accuracy. A revolver either is a so-called single-action handgun in which the hammer is cocked manually after each shot or it is a so-called double-action handgun in which the hammer may be cocked manually or by pulling the trigger.

Single-action revolvers and double-action revolvers when cocked manually simply cannot be fired rapidly. Although a double-action revolver when fired by trigger pull alone theoretically can be fired rapidly, in practice it posesses significant disadvantages because of the force required to cock the hammer and index the cylinder. That is, the force required to achieve these ends by trigger pull along is so great that accuracy is impaired greatly. The result is that double-action revolvers typically are fired in the double-action mode only in emergency circumstances or at close quarters where speed is gained at the expense of accuracy.

In an attempt to overcome this obvious defect of revolvers, others have attempted to utilize forces developed in the firing of a given cartridge to cock the hammer and index the cylinder preparatory to firing of the succeeding cartridge. In effect, the prior art has attempted to develop a successful semi-automatic revolver. An example is a prior art revolver in which a cylinder frame is displaced with respect to a handle portion of the firearm upon recoil, and in the process the hammer is cocked and the cylinder is indexed. This revolver is excessively bulky and unattractive, and has many exposed parts. The recoiling cylinder frame is dangerous and potentially ineffective if items such as fingers, portions of clothing, etc. are trapped between relatively moving parts. It is believed that the handgun is sufficiently unattractive that consumer acceptance has not occurred, even without regard to the other disadvantages.

The patents to Dickinson and Ivy disclose semi-automatic revolvers employing a somewhat different approach. Dickinson, for example, employs a longitudinally extending gas cylinder disposed beside the barrel; a piston reciprocates in the gas cylinder. A rod extends outwardly of the gas cylinder and is connected at one end to the piston and at the other end to the hammer by a pivoted link. The barrel includes an opening providing fluid communication between the barrel and the gas cylinder whereby the piston is forced rearwardly, and the hammer is cocked, upon the firing of a cartridge due to increased gas pressure in the barrel (and in the gas cylinder). Ivy in FIG. 10 discloses a similar concept, except that a two-part piston rod extends centrally through the cylinder and exits the frame immediately in front of the hammer. Upon the firing of a cartridge, the piston rods are displaced rearwardly and the piston rod closest to the hammer engages the hammer and cocks it, thus readying the handgun for the next shot.

Although this basic approach offers certain advantages, it is apparent that further advances are desirable. More specifically, it is desirable that the handgun effectively utilize space and that a minimum number of moving parts be exposed. It is necessary that moving parts be kept to a minimum and that the handgun be neither bulky nor unattractive. In short, a semi-automatic revolver must be simple, relatively inexpensive, compact, and most importantly, effective.

SUMMARY OF THE INVENTION

The present invention provides a new and improved semi-automatic revolver which overcomes the objections mentioned above and which is exceedingly simple and reliable. Because of its simplicity, lack of moving parts, and lack of exposed parts, the semi-automatic revolver according to the present invention permits the handgun to be fired exceedingly rapidly with great accuracy. The handgun is well-balanced, easy to clean, easy to assemble and disassemble, and may be adapted to existing revolver designs with a minimum of manufacturing effort.

The invention is characterized by a revolver having a barrel extending forwardly of a frame, the barrel having a bore for the passage of bullet. The barrel also includes a longitudinally extending gas cylinder displaced with respect to the bore and running generally parallel with the bore. The gas cylinder is positioned near an upper portion of the firearm and in communication with a bore formed in the frame; the frame bore extends rearwardly through the frame to exit the frame adjacent the hammer. A displaceable member such as a piston is disposed within the gas cylinder and the frame bore and is reciprocable therein. The displaceable member is biased to a forward position by a biasing means such as a spring.

The barrel includes an opening providing fluid communication between the bore and the gas cylinder so that, upon the firing of a cartridge, increased gas pressure in the bore is communicated to the gas cylinder. In turn, the increased gas pressure acts on the piston to displace it rearwardly so that the hammer is cocked and the cylinder is indexed in preparation for the next shot. If desired, the rearward portion of the gas cylinder may be vented to atmosphere to avoid compression of gases by the rearward face of the piston and, hence, permit ready reciprocation of the piston.

To preserve the aesthetics of the handgun, the gas cylinder extends within the barrel the full length of the barrel. Accordingly, a smooth, continuous sight line is presented from the rearward portion of the frame to the forward portion of the barrel. A ramp-like sight may be included as part of the barrel and disposed near the muzzle of the barrel.

To permit cleaning, facile assembly and disassembly of the components, and selective utilization of the automatic hammer-cocking and cylinder-indexing feature, a plug is threaded into the forward portion of the gas cylinder and forms the forwardmost portion of the gas cylinder. The plug essentially comprises a valve which in one position permits fluid communication between the bore and the remainder of the gas cylinder. In another position, fluid communication between the bore and the gas cylinder is not permitted so that the automatic hammer-cocking and cylinder-indexing feature may be disabled.

The plug comprises a threaded shank having an opening alignable with the opening in the barrel. The shank includes a longitudinally extending counterbored portion in its end which communicates with the opening. This construction permits fluid communication between the bore and the gas cylinder and also uniformly distributes gas pressure over the face of the piston.

A detent mechanism is provided for the plug to maintain the plug in one of two desired positions. The detent mechanism comprises a spring-loaded detent which engages one of two indented portions of the plug spaced from each other. In the first plug position, the openings are aligned so that the automatic hammer-cocking and cylinder-indexing feature is engaged. In the second plug position, the opening in the plug is moved so that the openings in the barrel and the plug are misaligned; hence, the automatic hammer-cocking and cylinder-indexing feature is disengaged.

Additional advantageous features of the invention will become apparent from the following detailed description of a preferred embodiment of the invention made with reference to the accompanying drawings which form a part of the specification.

DESCRIPTION OF THE PREFERRED EMBODIMENT

Figures 1, 2, 3, 4:
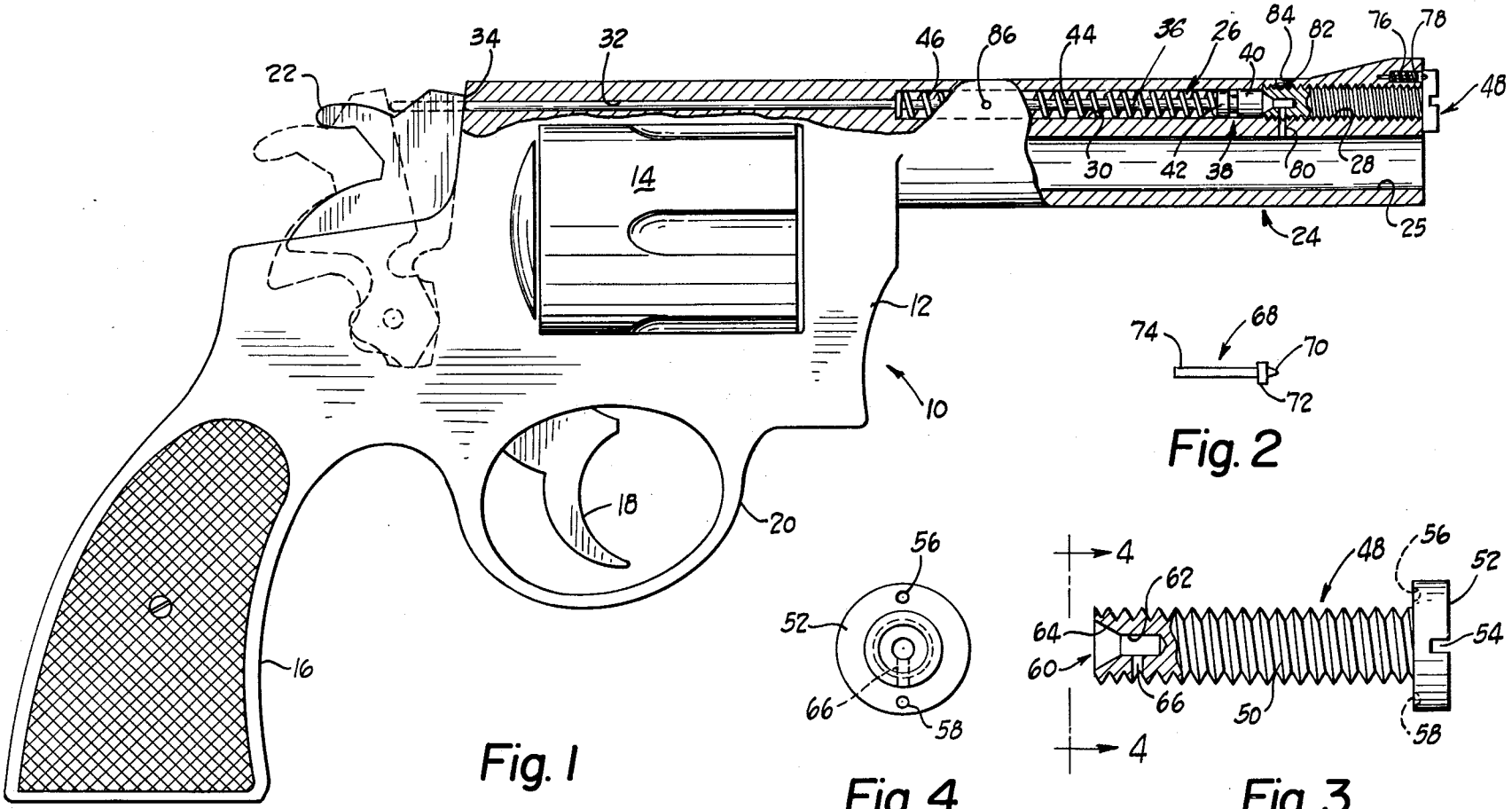
FIG. 1 is a side view, partly in section, of a semi-automatic revolver according to the invention.
FIG. 2 is a detailed view of a detent employed with the invention.
FIG. 3 is a view, partly in section, of a threaded plug employed with the invention.
FIG. 4 is a view taken along line 4—4 of FIG. 3.

A semi-automatic revolver 10 according to the invention is shown in FIG. 1. The revolver 10 includes a frame portion 12, a rotatable, indexable cylinder 14 having a capacity for six cartridges, a handle 16, a trigger 18, a trigger guard 20, and a pivotally mounted hammer 22. The handgun also includes a barrel 24 extending forwardly of the frame 12, which barrel 24 may be affixed threadedly to the frame 12 as is well known in the art. The barrel includes a rifled bore 25 for the passage of a bullet.

A gas cylinder 26 is included as part of the barrel 24 and extends generally longitudinally of the handgun, parallel to the bore 25. The gas cylinder comprises a first, forwardly disposed threaded portion 28 and a second portion 30 of a given diameter. A longitudinally extending bore 32 of lesser diameter than the second portion 30 is formed in the frame and communicates with the second bore 30. The portion 32 opens as at 34 at a rearward area of the frame 12, and the opening 34 is covered by the hammer 22 when the hammer is at rest. Taken together, the portions 28, 30, 32 provide a chamber running largely the length of the handgun from near the muzzle of the barrel 24 to the rearward portion of the frame 12 adjacent the hammer 22.

A displaceable member 36 is disposed within the gas cylinder 26 and the frame bore 32 for reciprocation. The displaceable member 36 comprises a piston 38 having enlarged, spaced portions 40, 42 as well as an elongate, cylindrical piston rod 44 affixed to the rearward face of portion 42. The piston rod 44 is sized appropriately to fit snugly within the frame bore 32 and may extend outwardly of the bore 32 through opening 34 upon being displaced rearwardly.

A biasing means such as a helical spring 46 is disposed within the second portion 30 of gas cylinder 26 and acts on the rearward face of portion 42 to urge the piston 38, and hence the piston rod 44, to a forward position within the gas cylinder 26.

The threaded portion 28 of the gas cylinder is closed by a threaded plug 48, shown in detail in FIGS. 3 and 4. The plug 48 comprises a threaded shank 50 and a head 52. The head 52 includes a slot 54 to permit the plug 48 to be tightly screwed into the gas cylinder 26. The head 52 also includes indents 56, 58 spaced diametrically on its underside.

The shank 50 includes a counterbored portion 60 comprised of a longitudinally extending bore 62 formed in the shank 50 opposite the head 52. The counterbored portion 60 also includes a diverging section 64 connecting the bore 62 with the end of the shank 50. The shank 50 also includes a radially extending opening 66 providing communication between the bore 62 and the exterior of the shank 50. The longitudinal axis of the opening 66 is aligned with the indent 56, as best shown in FIG. 4.

The invention also includes a spring loaded detent pin 68 (FIG. 2) comprised of a rounded end portion 70, an enlarged flange 72, and an elongate, rod-like shank 74. The detent pin 68 is disposed within a longitudinally extending opening 76 formed in the forward portion of the barrel 24. The detent pin 68 is biased to a forward position by a biasing means such as a helical spring 78.

The barrel 24 also includes a generally radially extending opening 80 which provides fluid communication between the interior of the barrel and the gas cylinder 26. In order to form the opening 80, an outer, radially extending opening 82 is formed in the barrel 24 and a threaded plug 84 is fitted tightly into the opening 82 after this operation is complete. By carefully controlling the dimensions of the plug 84, a smooth upper surface is provided for the barrel 24 and the plug 48 still can be fully threaded into the gas cylinder 26.

The gas cylinder 26 also includes a vent opening 86. The opening 86 comprises a small orifice formed in the side of the barrel 24 which relieves pressure within the gas cylinder 26 caused by displacement of the piston 38. The gas cylinder 26 could be vented in many places, but orifice 80 preferably opens on either side of the barrel 24 so that gases are directed away from the operator's face.

ASSEMBLY

From the foregoing it is apparent that assembly is straightforward. First, the barrel 24 is oriented generally upwardly. Springs 46 and 78 next are dropped into gas cylinder 26 and opening 76, respectively. Displaceable member 36 and detent pin 68 then are dropped into gas cylinder 26 and opening 76, respectively. Thereafter, the threaded plug 48 is screwed tightly into gas cylinder 26.

When all of this is complete, the radially extending openings 66, 80 are aligned so that fluid communication between the interior of the barrel 24 and the gas cylinder 26 exits. The threaded plug 48 is maintained in this position by the spring-loaded detent pin 68 which engages indent 56 so that this alignment is maintained. Spring 46 acts on portion 42 of piston 38 so that displaceable member 36 constantly is urged to a forward position. Accordingly, portion 40 of piston 38 engages the end portion of shank 50 and piston rod 44 is retracted within frame bore 32 so that the end of the piston rod 44 is flush with the opening 34.

OPERATION

It will be assumed that the handgun is a conventional single-action or double-action revolver in which the first cartridge just has been fired. The resultant explosion and increased gas pressure forces the bullet forwardly towards the muzzle of the barrel. As the bullet passes opening 80, a small amount of gas is diverted through the openings 80, 66 and into gas cylinder 26. This gas acts against portion 40 of piston 38, forcing the displaceable member 36 rearwardly against the spring bias. Because counterbored portion 60 includes diverging section 64, the gas is distributed uniformly over the surface of portion 40.

Rearward movement of the displaceable member 36, causes its piston rod 44 to engage the hammer 22 and force it rearwardly to the dotted line position in FIG. 1. The rearward motion of the hammer cocks the hammer and indexes the cylinder, thus readying the revolver for the next shot. As the hammer 22 reaches its cocked position, the bullet by this time has exited the bore 25, causing a rapid reduction in gas pressure within the bore 25 and the gas cylinder 26.

The spring 46 which was compressed upon rearward displacement of displaceable member 36 now exerts sufficient force on portion 42 of piston 38 so that displaceable member 36 returns to the solid line position shown in FIG. 1. This completes the cycle and the revolver is ready for the next shot.

Because the gas cylinder 26 is vented through opening 86, reciprocation of the displaceable member 36 is permitted readily. It will be appreciated that the strength of the spring 46, the diameter of gas cylinder 26, the diameter of openings 66, 80, and so forth must be selected carefully. It is common knowledge that operating mechanism sensitivity, muzzle velocities, and similar factors vary widely from handgun to handgun and caliber to caliber and it will be understood that one skilled in the art will select components of appropriate size and strength to produce the desired result.

The invention also permits selective control of the automatic cocking and indexing feature. This is achieved simply by rotating threaded plug 48 so that indent 58 now is engaged by detent pin 68. By screwing the threaded plug 48 one-half turn out of the gas cylinder 26, the openings 66, 80 now are misaligned and the firing of a cartridge will not automatically prepare the revolver for the next shot because fluid communication between the interior of the bore 25 and the gas cylinder 26 no longer is possible. Clearly, indents 56, 58 do not have to be spaced 180° as illustrated, but this is of greatest convenience. The indents 56, 58 obviously can be spaced any amount so long as the openings 66, 80 can be misaligned when desired.

Disassembly and cleaning of the handgun, like assembly, is straightforward. Threaded plug 48 simply is removed from gas cylinder 26 and the barrel 24 is pointed downwardly and tapped lightly. The displaceable member 36, detent pin 68, and springs 46, 78 then will fall out of their respective openings. The parts then may be cleaned and reassembled with a minimum of inconvenience.

Largely because of the location of the gas cylinder 26 and the location of the threaded plug 48, the invention provides significant advantages. The invention makes effective use of that space atop the barrel 24 formerly unused in many handguns; the frame 12 extends smoothly from near the hammer 22 to the ramp-like sight formed at the muzzle of the barrel 24. The strength of the handgun is improved, its appearance is not affected adversely, and it remains well-balanced.

Because the displaceable member 36 is fully retracted when not in use, and because the opening 34 is covered by the hammer 22, dirt will not enter the gas cylinder 26 and nothing will be trapped between moving parts. In essence, the invention requires only one moving part and this moving part is exposed only for the briefest instant during firing. The invention clearly is effective and reliable because of these features.

Although the invention has been described with a certain degree of particularly, it will be appreciated that the present disclosure of the preferred embodiment has been made only by way of example. Various changes in the details of construction may be resorted to without departing from the true spirit and scope of the invention and it is intended to cover all such changes in the appended claims.

What is claimed is:

1. A cocking mechanism for a revolver having a frame, a rotatable cartridge receiving cylinder rotatable about an axis, a barrel extending forwardly of the frame, the barrel having a barrel bore for the passage of a bullet, and a hammer disposed near a handle portion of the firearm, the combination comprising:

(a) the barrel including an elongated gas chamber, the gas chamber extending generally longitudinally of the frame and the barrel and being spaced from the cartridge cylinder axis;

(b) the frame including a frame bore, the frame bore extending generally longitudinally of the frame and the barrel and being in communication with the gas chamber;

(c) a piston assembly including a piston disposed within the gas chamber for reciprocation and a piston rod connected to the piston, the piston rod being at least partially disposed in the frame bore, the piston rod being adapted to project from the frame bore to contact the hammer and cock the hammer upon reciprocation of the piston and the piston rod;

(d) biasing means interposed between the piston and one of the frame and barrel to urge the piston toward a forward portion of the gas chamber whereby the piston rod is urged to a retracted position within the frame bore; and, (e) the barrel bore having an opening in communication with the gas chamber so that pressure generated in the barrel bore by the firing of a cartridge may act upon the piston to displace the piston against the biasing means, whereby the piston rod may be displaced outwardly of the frame bore and the hammer may be cocked automatically.

2. The apparatus of claim 1, further including a valve disposed intermediate the gas chamber and the opening in the barrel bore to permit selective control of reciprocation of the piston.

3. The apparatus of claim 1 wherein the chamber is above the barrel bore when the revolver is fired.

4. The apparatus of claim 1, wherein the gas cylinder includes a vent opening to relieve gas pressure generated by the rearward face of the piston upon displacement of the piston rod outwardly of the frame.

5. The apparatus of claim 1, wherein the centerline of the gas chamber, the barrel bore, and the frame bore generally are in the same plane.

6. The apparatus of claim 1, wherein the opening providing communication between the bore in the barrel and the gas chamber extends radially of the centerline of the bore.

7. In a revolver having a frame, a handle, a hammer, an indexible cylinder having longitudinally extending openings for holding cartridges, a trigger for releasing the hammer and indexing the cylinder, and a barrel extending forwardly of the frame, the barrel having a barrel bore for the passage of a bullet, the improvement comprising:

(a) a gas cylinder extending longitudinally of the barrel;

(b) a frame bore extending longitudinally of the barrel and passing rearwardly through the frame to exit the frame adjacent the hammer, the centerlines of the gas cylinder and the frame bore being substantially coincident;

(c) a displaceable member disposed within the gas cylinder and the frame bore, the displaceable member extending largely the length of the gas cylinder and the frame bore;

(d) the barrel having an opening intermediate its ends, the opening providing fluid communication between the barrel bore and the displaceable member disposed within the gas cylinder, whereby increased gas pressure within the barrel bore may act on the displaceable member to move it rearwardly into engagement with the hammer;

(e) biasing means disposed within the gas cylinder to return the displaceable member to a retracted position upon the release of pressure in the gas cylinder; and (f) the centerline of the barrel bore being disposed intermediate the axis of rotation of the indexible cylinder and the centerlines of the gas cylinder and the frame bore.

8. The apparatus of claim 7, wherein the gas cylinder includes a vent to relieve pressure within the gas cylinder to permit the ready reciprocation of the displaceable member.

9. The apparatus of claim 7, wherein the gas cylinder includes a plug extending into the portion of the gas cylinder disposed near the forward portion of the barrel, the plug covering the opening in the barrel and including an opening communicable with the opening in the barrel to permit fluid communication between the bore and the gas cylinder, the opening in the plug, upon movement of the plug, being out of registry with the opening in the barrel whereby fluid communication between the bore and the gas cylinder may be prevented.

10. The apparatus of claim 9, wherein the plug extends generally longitudinally of the gas cylinder and is threaded into the gas cylinder.

11. The apparatus of claim 9, wherein the plug includes a counterbored portion facing the displaceable member and in communication with the opening in the plug, whereby gas pressure may be distributed uniformly over the displaceable member.

12. The apparatus of claim 9, further comprising indexing means in engagement with the plug, the indexing means permitting selective, positive alignment of the openings in the plug and the barrel or selective, positive misalignment of the openings.

13. In a revolver having a frame, a handle, a hammer, an indexible cylinder having longitudinally extending openings for holding cartridges, a trigger for releasing the hammer and indexing the cylinder, and a barrel extending forwardly of the frame, the barrel having a barrel bore for the passage of a bullet, the improvement comprising:

(a) the barrel including a longitudinally extending gas chamber;

(b) the frame including a frame bore extending longitudinally passing rearwardly through the frame to exit the frame adjacent the hammer, the gas chamber and the frame bore being interconnected;

(c) a displaceable member disposed within the gas chamber and the frame bore, the displaceable member extending largely the length of the gas chamber and the frame bore;

(d) the barrel having an opening intermediate its ends, the opening providing fluid communication between the barrel bore and the displaceable member disposed within the gas cylinder, whereby increased gas pressure within the barrel bore may act on the displaceable member to move it rearwardly into engagement with the hammer;

(e) biasing means disposed between the displaceable member and one of the barrel and frame to return the displaceable member to a retracted position upon the release of pressure in the gas chamber;

(f) the centerline of the barrel bore being disposed intermediate the axis of rotation of the indexible cylinder and the centerlines of the gas chamber and the frame bore; and, (g) a plug extending into a portion of the gas chamber disposed near the forward portion of the barrel, the plug covering the opening in the barrel and including an opening communicable with the opening in the barrel to permit fluid communication between the bore and the gas chamber, the opening in the plug, upon movement of the plug, being out of registry with the opening in the barrel whereby fluid communication between the bore and the gas chamber may be prevented.

* * * * *

UNITED STATES PATENT AND TRADEMARK OFFICE

CERTIFICATE OF CORRECTION

PATENT NO. : 4,197,784

DATED : April 15, 1980

INVENTOR(S) : Robert W. Williams

It is certified that error appears in the above-identified patent and that said Letters Patent are hereby corrected as shown below:

In Column 5, line 9, "exits" should be --exists--

Signed and Sealed this

*Fifth* Day of *August 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,197,784

DATED : April 15, 1980

INVENTOR(S) : Robert W. Williams

It is certified that error appears in the above-identified patent and that said Letters Patent are hereby corrected as shown below:

In column 4, line 1, "bore" should be --portion--;
"portion" should be --bore--.

In column 1, line 44, "along" should be --alone--.

Signed and Sealed this

*Twenty-sixth* Day of *August 1980*

[SEAL]

*Attest:*

SIDNEY A. DIAMOND

*Attesting Officer*

*Commissioner of Patents and Trademarks*